US006260735B1

(12) United States Patent
Fuquen

(10) Patent No.: US 6,260,735 B1
(45) Date of Patent: Jul. 17, 2001

(54) UNIFORM DISPENSING DUAL CHAMBER SACHET

(75) Inventor: Orlando Fuquen, Trenton, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/569,664

(22) Filed: May 12, 2000

(51) Int. Cl.[7] ..... B65D 35/22
(52) U.S. Cl. ..... 222/94; 222/541.9
(58) Field of Search ..... 222/92, 94, 107, 222/129, 541.6, 541.9

(56) References Cited

U.S. PATENT DOCUMENTS

| | | | | |
|---|---|---|---|---|
| 2,635,788 | | 4/1953 | Snyder et al. . | |
| 3,182,728 | * | 5/1965 | Zabriskie | 222/94 |
| 4,364,474 | * | 12/1982 | Hollander, Jr. | 222/94 |
| 4,717,046 | | 1/1988 | Brogli . | |
| 4,871,091 | | 10/1989 | Preziosi . | |
| 5,290,105 | | 3/1994 | Tencati . | |
| 5,535,885 | | 7/1996 | Daniel . | |

FOREIGN PATENT DOCUMENTS

| | | | | |
|---|---|---|---|---|
| 1056953 | | 5/1959 | (DE) . | |
| 2226290 | * | 6/1987 | (EP) | 222/94 |
| 061695 | | 5/1955 | (FR) . | |
| 2644141 | | 9/1990 | (FR) . | |
| 1389552 | | 4/1975 | (GB) . | |
| 0294446 | | 11/1989 | (JP) . | |
| 0233367 | | 9/1990 | (JP) . | |
| 406179461 | | 6/1994 | (JP) . | |
| WO 88/02339 | * | 4/1988 | (WO) | 222/94 |

* cited by examiner

*Primary Examiner*—Philippe Derakshani
(74) *Attorney, Agent, or Firm*—Michael J. McGreal

(57) ABSTRACT

The present dual chamber sachet overcomes the problem of non-uniform dispensing when the sidewalls of the sachet are depressed. Through the use of a relatively thin intermediate divider wall, rounded corner edges at the lower end of each chamber of the sachet, tapered side edges up to the exit channel of each chamber of the sachet, and a relatively wide dispensing opening uniform dispensing can be achieved. This structure prevents the downward flow of substances in each chamber during dispensing. The substances are directed upwardly by the rounded lower corners of the sachet, the tapered upper walls and the wide dispensing opening. This relatively wide dispensing opening minimizes the back pressure caused by the substances flowing to a dispensing exit of a width less than that of the product chambers.

12 Claims, 1 Drawing Sheet

UNIFORM DISPENSING DUAL CHAMBER SACHET

FIELD OF THE INVENTION

This Invention relates to a dual chamber sachet that substantially uniformly dispenses the substances from each chamber when the sidewalls of the sachet are depressed. More particularly, this invention relates to a construction of a dual chamber sachet that provides for the uniform dispensing of the substances stored in each chamber of the dual sachet.

BACKGROUND OF THE INVENTION

Sachets are small packets that are used for supplying small doses of a product. These are used to dispense single or a small number of doses of adhesives, lubricants, medicines, cosmetics, shampoos, conditioners, liquid soaps, lotions and dentifrices. In some instances a single dose is a sample amount. Regardless such sachets are commonly used to deliver a single dose of a substance.

In most instances the sachets will be used to deliver a single dose of a single substance. However, in some instances they will be used to dispense doses of two different substances. Further, in most instances in the delivery of two different substances, these substances must be delivered substantially uniformly. That is, each of the substances should be dispensed in about equal amounts. This is needed for the effective use of the substances being dispensed. When the substances are components of an adhesive they are reactive and must be dispensed and used in a certain reactive ratio. Medications also must be used in a certain ratio. The same is the case for a dentifrice that is comprised of two non-compatible components. These types of substances need sachets that will reliably dispense the substances from each chamber in substantially uniform amounts. The present sachet is directed to solving this problem.

BRIEF SUMMARY OF THE INVENTION

The present dual chamber sachet has a construction to facilitate the uniform dispensing of substances. The sachet is comprised of a front wall, a rear wall and an intermediate divider wall. The peripheral edges of a first and second side edge and of a lower and upper edge of the walls are bonded together to provide a container with two separate chambers. The chambers have rounded corners at a lower end of each chamber and in an upper part of each chamber sidewalls which taper to a tapered exit channel. The exit channel has less of a taper than the upper part of the chamber sidewalls. The exit channel extends a distance from the top of the chambers. The exit channel will have a notch adjacent the product chambers for the removal of a part of the exit channel and to thereby open the exit channel at about the commencement of the exit channel.

The chambers of the sachet are sized so that the width of a person's thumb will extend across a substantial portion of the width of the sachet. This in combination with an orifice that is about 75% to 100% the width of a toothbrush, and about 35% to 65% of the width of the product chambers, provides for a uniform dispensing from the sachet. In addition, the sachet opens at about the commencement of the tapered wall exit channel. This provides for a comparatively wide exit opening for the more uniform delivery of the products from each of the chambers of the sachet. Further, the sachet is symmetrical about a vertical plane through the peripheral edges of the sachet.

The intermediate divider wall will have a thickness of about 10% to about 70% of that of either the front wall or rear wall, and preferably about 25% to about 50%. Further, the intermediate divider wall will have good barrier properties and will contain a film such as one selected from the group comprising polyethylene terephthalate, polypropylene, biaxially oriented polypropylene, metal foils, polyethylene, low density polyethylene, ethylene vinyl acetate copolymers, ethylene vinyl alcohol copolymers and polyacrylonitrile/styrene polymer resins. The front and rear walls will be comprised of a film selected from the same polymers and copolymers. These will be used primarily in various laminate structures.

DETAILED DESCRIPTION OF THE DRAWINGS

The sachet of this invention will now be described in its preferred embodiments with reference to the drawings.

Figure 1:
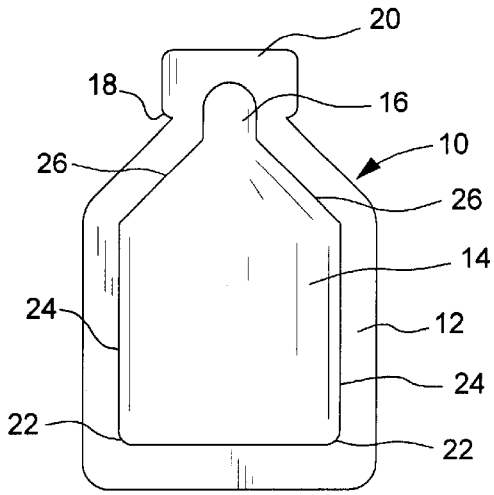
FIG. 1 (PRIOR ART)
FIG. 1 is a plan view of a prior art dual chamber sachet.

FIG. 1 shows a prior art design for a dual chamber sachet. The sachet 10 has a peripheral seal area 12, a substance container 14 with an exit channel 16. The exit channel 16 extends up into tab 20. Adjacent the exit channel there are notches 18 in the peripheral seal area. These notches define a weakened area where in a tearing motion the tab 20 can be removed from the sachet. This opens the sachet for dispensing. The lower walls of this sachet are angled at about 90° at corners 22. The sidewalls 24 are essentially straight with a tapering section 26 prior to a relatively narrow exit channel 16. Further, this sachet is opened near the end of the exit channel a distance from the product chambers.

A problem with this sachet design is that as the sachet walls are depressed to dispense substances from each chamber of the sachet some of the substances will be forced downward into areas of corners 22 of the sachet. This substance will not be dispensed. This is the result of the essentially 90° angle to the lower corners, the straight sidewalls and relatively narrow dispensing opening. Further, depending on how the sachet is being held during dispensing, more of the substance in one chamber will be flowed into the corners than that in another chamber. The result is non-uniform dispensing.

Figure 2:
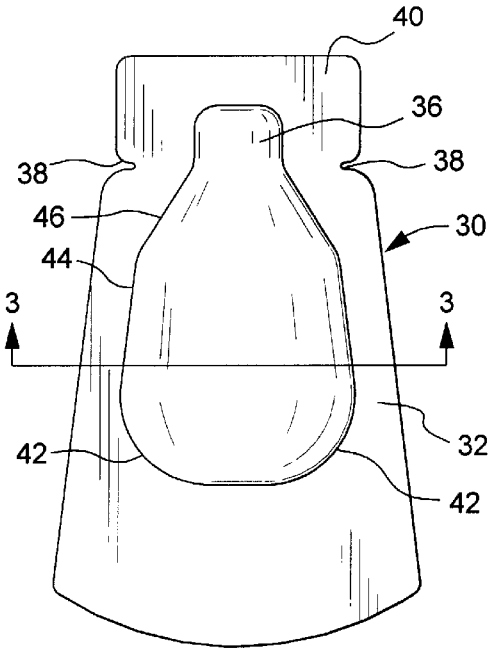
FIG. 2 is a plan view of the present dual chamber sachet.

In FIG. 2 there is shown a sachet that overcomes these problems of non-uniform dispensing. The sachet 30 has a peripheral area 32 and a substance chamber area 34. There is a dispensing channel 36 and a tab 40. Notches 38 provide a weakened point for the removal of tab 40 to thereby open exit channel 36 for dispensing the substances from the chamber area 34. The chamber has rounded lower corners 42, tapering lower sidewalls 44 and increased tapering upper sidewalls 46. The rounded corners 42 prevent the substance in each chamber from flowing into the corners during a dispensing. The wide exit channel results in a decreased resistance to flow of product from the sachet. The exit channel has a width of about 35% to about 65% of the width of the substance chambers at their widest point.

Figure 3:
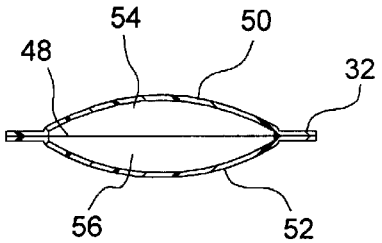
FIG. 3 is a cross-sectional view of the dual chamber sachet of FIG. 2 along line 3—3.

FIG. 3 shows the sachet in cross-section. There is shown a front wall 50, intermediate divider wall 48 and a rear wall 52. This structure forms chambers 54 and 56.

The sachet has a chamber area that has a width of about 50% to about 100% of the width of a person's thumb. This, in combination, with round lower edges, tapering sidewalls, and an exit channel having a width that is about 75% to about 100% of the width of a toothbrush provides a uniform dispensing from the sachet. Further, in a preferred embodiment the sachet is symmetrical about a vertical plane through the peripheral area 32. This all contributes to the uniform dispensing from the sachet.

Figure 4:
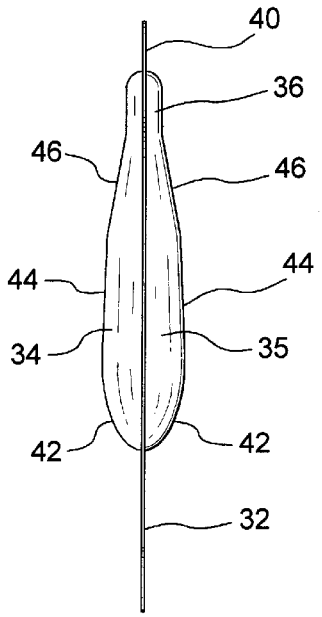
FIG. 4 is a side elevational view of the dual chamber sachet.

FIG. 4 shows the sachet in a side elevational view. This view shows the sachet as being symmetrical about a plane through the peripheral area 32. The divider wall 18 lies in this plane. This divider wall forms the chambers 54 and 56. This view shows the rounder, lower corners 42, first tapered sidewalls 44 and second tapered sidewalls 46. The second tapered sidewalls have a greater taper than the first tapered sidewalls.

The outer walls 50 and 52 will usually be the same material. These walls can be of a monolayer or a multilayer film structure. Suitable films are set out in the following Table 1 where PET is polyethylene, terephthalate; Barex is polyacrylonitrile and polystyrene resin; BOPP is biaxially oriented polypropylene; LDPE is low density polyethylene; PE is polyethylene; and EVOH is ethylene-vinyl alcohol copolymer.

TABLE 1

| |
|---|
| PET/Aluminum Foil/Barex |
| PET/Aluminum Foil/LDPE |
| BOPP/Aluminum Foil/Barex |
| BOPP/Aluminum Foil/LDPE |
| LDPE/EVOH/LDPE |
| PET/EVOH/LDPE |
| BOPP/EVOH/LPDE |
| LPDE Based Monolayer Or Polyefins Blend |
| Sealable PET Based Monolayer |
| PET/PE/Sealable PET |
| PET/Foil/Sealable PET |
| Nylon/Foil/PE |
| Nylon/PE/Sealable PET |

The intermediate divider wall is comprised of a barrier film which likewise can be of a monolayer or a multilayer structure. Suitable films are set out in Table 2.

TABLE 2

| |
|---|
| LPDE Based Or Polyefins Blend Monolayer |
| Barex Monolayer |
| LDPE/Aluminum Foil/LDPE |
| Barex/Aluminum Foil/Barex |
| LDPE/EVOH/LDPE |
| Sealable PET/PE/Sealable PET |
| Sealable PET/Foil Sealable PET |
| PE/Nylon/PE |

The packets are made from three films bonded together at their periphery. The bonding is by a heat sealing. In this regard the layers that are in contact and that are to be heat bonded together must be head bondable to each other. Suitable selections can be made from Table 1 and Table 2. Usually the sachet will be formed and filled in a continuous operation. The printing and decoration will be on the film outer walls when the webstocks are fed to a sachet making station.

The sachets can be made from various materials with those that are preferred set out in Table 1 and Table 2. In addition, the sachets can be formed and filled in a continuous process or the sachets made and later filled. The primary factor in the present sachet is the shape of the sachet product chambers to deliver a uniform amount of the product in each chamber when squeezed to dispense the products.

What is claimed is:

1. A dual chamber sachet for uniform dispensing of substances comprising a front wall, rear wall and an intermediate divider wall, front wall and rear wall peripheral edges of a first and second side edge, a lower edge and an upper edge bonded together to form a container with two chambers with lower corners, the lower corners of said chambers being rounded, an upper portion of said chambers having edges that taper to an exit channel whereby upon depressing the front wall and rear wall of the sachet the substances in the chambers are substantially uniformly dispensed.

2. A dual chamber sachet as in claim 1 wherein the upper edge portion of said chambers have a first taper from said lower corners and a second taper adjacent said exit channel, said second taper being at a greater angle than said first taper.

3. A dual chamber sachet as in claim 1 wherein said exit channel extends upwardly from said two chambers, an end of said exit channel distant from said two chambers closed by the peripheral seal of the upper edge.

4. A dual chamber sachet as in claim 3 wherein adjacent said exit channel there is at least one notch in at least one of the first and second side edge whereby a portion of said channel at said at least one notch can be removed to thereby open said exit channel.

5. A dual chamber sachet as in claim 4 wherein said notch is at the commencement of said exit channel.

6. A dual chamber sachet as in claim 4 wherein the exit channel has a width of about 35% to 65% that of the chambers at their widest point.

7. A dual chamber sachet as in claim 1 wherein said intermediate divider wall has a thickness that is from about 10% to about 70% of that of either of the rear wall or front wall.

8. A dual chamber sachet as in claim 7 wherein said intermediate divider wall has a thickness that is form about 25% to about 50% of that of either of the rear wall or front wall.

9. A dual chamber sachet as in claim 1 wherein the intermediate divider wall is comprised of a barrier film selected from the group consisting of monolayer and laminate films.

10. A dual chamber sachet as in claim 9 wherein the front wall and the rear wall are comprised of a film selected from the group consisting of monolayer and laminate films.

11. A dual chamber sachet as in claim 1 wherein ratio of the length of the container to the width of the container is about 1:1 to about 4:1.

12. A dual chamber sachet as in claim 11 wherein ratio of the length of the container to the width of the container is about 1.5:1 to about 3:1.

* * * * *